United States Patent [19]

Otouma et al.

[11] 4,144,121

[45] Mar. 13, 1979

[54] METHOD FOR PRODUCING ASBESTOS-FREE CALCIUM SILICATE BOARD AND THE BOARD PRODUCED THEREBY

[75] Inventors: Takashi Otouma, Yokohama; Hiroshi Asaumi, Kamakura; Kazuo Kubota, Yokosuka; Mitsuo Yamamoto, Yokohama, all of Japan

[73] Assignee: Nippon Asbestos Co., Ltd., Japan

[21] Appl. No.: 793,358

[22] Filed: May 3, 1977

[30] Foreign Application Priority Data

May 10, 1976 [JP] Japan ..... 51-53016

[51] Int. Cl.[2] ..... D21H 5/18; C04B 7/34

[52] U.S. Cl. ..... 162/145; 106/120; 162/147; 162/148; 162/152

[58] Field of Search ..... 162/145, 181 C, 154, 162/152, 147, 148; 106/118-120; 264/82

[56] References Cited

U.S. PATENT DOCUMENTS

| | | | |
|---|---|---|---|
| 2,309,206 | 1/1943 | Newman | 162/154 |
| 2,888,377 | 5/1959 | Allen | 162/181 C |
| 3,219,467 | 11/1965 | Redican et al. | 162/154 |
| 3,352,746 | 11/1967 | Williams et al. | 162/181 C |
| 3,794,505 | 2/1974 | Hesler et al. | 106/119 |
| 3,804,651 | 4/1974 | Semler | 106/120 |

FOREIGN PATENT DOCUMENTS

| | | | |
|---|---|---|---|
| 565592 | 11/1958 | Canada | 162/145 |
| 2227001 | 12/1972 | Fed. Rep. of Germany | 162/181 C |
| 1421556 | 1/1976 | United Kingdom | 162/145 |

*Primary Examiner*—Richard V. Fisher
*Assistant Examiner*—Peter Chin
*Attorney, Agent, or Firm*—Wenderoth, Lind & Ponack

[57] ABSTRACT

This invention relates to a method for making an asbestos-free calcium silicate board, which comprises preparing a slurry of a mixture of silicic acid material, lime material, fibrous wollastonite and pulp with a large amount of water, forming the slurry into a raw board by means of the sheet-forming technique, steaming the raw board and drying. This invention also relates to the board produced in accordance with the above method.

3 Claims, No Drawings

METHOD FOR PRODUCING ASBESTOS-FREE CALCIUM SILICATE BOARD AND THE BOARD PRODUCED THEREBY

DETAILED EXPLANATION OF THE INVENTION

This invention relates to a method for making a calcium silicate board containing no asbestos (hereinafter referred to as "asbestos-free calcium silicate board") and the board made thereby. More particularly, this invention relates to a method for making as asbestos-free calcium silicate board having excellent properties comparable to those of calcium silicate board containing asbestos by using calcium silicate as a matrix without using asbestos.

Heretofore, an asbestos-containing calcium silicate board prepared by means of the sheet-forming technique (i.e. paper-making technique) using asbestos has been widely used as light non-combustible building material (bulk density = 0.7 − 1.4 g/cm$^3$) since it is highly heat-resistant, fire-resistant and easily processible with a saw or the like and has a high specific strength. Asbestos has contributed to the development of the conventional calcium silicate board to a great extent on the following grounds. That is, since asbestos is fiber having a specific surface area of several thousands cm$^2$/g or more, it sufficiently adsorbs the powders of silicic acid and lime materials which are the starting materials for calcium silicate and accordingly these materials are not lost at the hydration step. Moreover, since asbestos has an appropriate filterability (i.e. freeness), calcium silicate can be easily formed into a sheet-like or board-like product in combination with asbestos by means of the sheet-forming technique. Furthermore, asbestos is highly alkali-resistant, and therefore it does not deteriorate at the steaming and drying steps even in the presence of highly alkaline calcium hydroxide. Thus, asbestos plays various important parts in the preparation of calcium silicate board. Since asbestos fiber is not only strong and bulky but also has a high affinity for calcium silicate, it provides various significant properties to calcium silicate board as mentioned above.

However, on a worldwide scale demand for asbestos has rapidly increased and its preserves are being drained. Accordingly, the price of asbestos has risen excessively and it has become difficult to obtain required amounts of asbestos for a reasonable price. In addition to these circumstances, asbestos has been indicated to be a carcinogenic substance and therefore its use as industrial starting material is being limited in view of working environment sanitation. On the other hand, in the building industry and ship building industry, the use of non-combustible material is being required as building material and therefore non-combustible building material, particularly calcium silicate board which can be prepared at a relatively low cost on a large scale by means of the sheet-forming technique is in wide demand.

Under these circumstances, a process for preparing an asbestos-free calcium silicate board by means of the sheet-forming technique without using asbestos has been studied. Difficulties in this process reside in that there is no appropriate substitute for asbestos which is comparable to asbestos in view of the various properties and processibility. In these circumstances, various organic fibers such as natural pulp, flax pulp and rayon, and various glassy fibers such as rock wool, A-glass fiber and E-glass fiber, and mixtures thereof have been studied.

However, organic fiber has a disadvantage that it is combustible, and therefore its use is limited, while glassy fiber is poor in alkali-resistance, and therefore it can not be satsifactorily used since the fiber is deformed and its strength is extremely reduced by the presence of calcium hydroxide in the steaming process. Recently, alkali-resistant glassy fiber has been developed and a process for preparing an asbestos-free calcium silicate board by combining the alkali-resistant glassy fiber with a small amount of organic fiber has been studied. However, this alkali-resistant glassy fiber has a smooth surface and a poor affinity for other material, and moreover it is stiff and poor in flexibility. Furthermore, since the concentration of the starting slurry is much thinner in the dehydration-forming process using the sheet-forming technique (i.e. paper-forming technique) than in a press dehydration-forming process, particles of the starting material do not remain on the screen but are lost by passing therethrough. Thus, appropriate filterability (or freeness) of the slurry which is required in the sheet-forming technique can not be attained, and it is therefore very difficult to prepare an asbestos-free calcium silicate board by means of the sheet-forming technique.

We have studied a method to remove the above mentioned disadvantages of the conventional process, and as a result of this study, we have succeeded in producing calcium silicate board in the absence of asbestos by means of the sheet-forming (i.e. paper-forming) technique using calcium silicate as a matrix which board has excellent properties comparable to those of the conventional calcium silicate board containing asbestos, and the specific gravity of which is adjusted to the desired valve.

That is, an object of this invention is to provide a method for making an asbestos-free calcium silicate board, which comprises preparing a slurry of a mixture of silicic acid material, lime material, fibrous wollastonite and pulp with a large amount of water, forming the slurry into a raw board by means of the sheet-forming technique (i.e. paper-forming technique), steaming the raw board and then drying.

Another object of this invention is to provide the asbestos-free calcium silicate board produced in accordance with the above method.

A still another object of this invention is to provide a method for making an asbestos-free calcium silicate board in which the slurry of the above method additionally includes calcium silicate crystal hydrothermally synthesize, and the asbestos-free calcium silicate board produced thereby.

Fibrous wollastonite used in the present invention has the properties mentioned in the following Table 1 and imparts an excellent reinforcing effect to the calcium silicate product of this invention.

The fibrous wollastonite preferably has a relatively larger fiber length, i.e. a median value of 19 $\mu$ or large for 50% of the fiber distribution according to granulometry by sedimentation rate. The amount of the fibrous wollastonite added is preferably in the range of 10 to 40% of the total starting material (solid content) in the case that the slurry of calcium silicate crystal hydrothermally produced is added, and in the range of 10 to 30% in the case that the calcium silicate crystal slurry is not added. In each case, if the amount added is less than 10%, a sufficiently satisfactory effect in the processing efficiency and the properties of the final product can not be achieved. If the amount of the fibrous wollastonite added exceeds the upper limit mentioned above, i.e. 40% in the former case and 30% in the latter case, it becomes difficult to reduce the specific gravity of the final product, and the product becomes brittle and poor in mechanical strength.

Table 1

| | |
|---|---|
| Chemical formula | $CaSiO_3$ |
| Crystal structure | needle-like |
| True specific gravity | 2.9 |
| Expansion coefficient | $6.5 \times 10^{-6}$ mm/° C |
| Melting point | 1,540° C |
| Hue | glossy white |
| PH (10% slurry) | 9.9 |

Pulp used in this invention includes various commercially available pulps such as N-BKP (needleleaved tree bleached kraft pulp), N-UKP (needleleaved tree unbleached kraft pulp), flax pulp, waste paper and the like. The amount of pulp used must be limited to 2 to 10% of the weight of the total starting materials (solid content) since they are combustible. The addition of pulp improves not only dispersibility, adsorption capacity and filterability (or freeness) at the preparation step by means of the sheet-forming technique but also dry strength of the produced board and other products.

Examples of silicic acid material used in this invention include siliceous sand, diatomaceous earth, ferrosilicon dust, silicon dust and the like. The silicic acid material is used in an amount of 20 to 50% of the total weight of the starting materials (solid content).

Examples of lime material used in this invention include slaked lime, quick lime, carbide residue, cement and the like. The lime material is used in an amount of 20 to 50% of the total weight of the starting materials (solid content).

Said calcium silicate crystal slurry is used to obtain a relatively lighter product having a specific gravity of 0.7–1.0, compared with a specific gravity of 0.7–1.4 in general for asbestos-free calcium silicate board of this invention.

The addition of the calcium silicate crystal slurry improves the processability of the produced substrate by imparting flexibility to the substrate and also improves its suitability for sheet-forming by improving the capacity of the fibrous wollastonite to adsorb powdery material. The calcium silicate crystal is prepared by hydrothermally synthesizing silicic acid material and lime material in an autoclave, and its main component includes xonotolite crystal, tobermorite crystal and their mixed crystal as disclosed in U.S. Pat. No. 3,679,446 (British Pat. No. 1,277,271). Calcium silicate crystal slurry is added in a solid content amount of 1–30%, preferably 5–25% (on the basis) of the total weight (solid content). The addition of the calcium silicate provides various properties. If the above amount is less than 1%, sufficient effects can not be expected in respect to ability to lighten, processability and the like. If the above amount exceeds 30%, filterability (or freeness) becomes very bad and it becomes difficult to prepare a board-like or paper-like product by means of the sheet-forming technique.

Since the slurry mixture prepared in accordance with this invention comprises fibrous wollastonite, pulp, silicic acid material, lime material and a large amount of water and particles of the materials cohere to and are adsorbed on the fibrous wollastonite, they satisfactorily remain on a screen and an appropriate filterability (i.e. freeness) is provided with regard to these materials. Moreover, dispersiblity of these materials is good enough to obtain satisfactory texture conditions. Thus, the various conditions required with regard to the sheet-forming process are satisfied, and consequently it has become possible to prepare a raw board of asbestos-free calcium silicate having excellent properties comparable to those of asbestos-containing calcium silicate board, in the absence of asbestos, at a high yield by means of the usual sheet-forming technique. The addition of calcium silicate crystal slurry improves the suitability for sheet-forming in the following manner. In the slurry of the mixture of the starting materials, particles of silicic acid material and lime material cohere to and are adsorbed or embedded on the calcium silicate crystal gel used as a seed, thereby forming relatively large particles. The particles thus formed are adsorbed on or between fibers of fibrous wollastonite and pulp, and in the dehydration step the slurry of the mixture of the starting materials is filtered on the fibrous wollastonite which acts as a screen. The particles do not block the pores of the fibrous wollastonite so much as to merely increase filtration resistance.

Just before the sheet-forming step, an appropriate amount of flocculant or aluminium sulfate may optionally be added to the slurry in order to accelerate adsorption and agglomeration. Moreover, bentonite or sodium silicate may be added to the slurry in order to control freeness (filterability) and to improve bonding between layers after rolling.

An asbestos-free calcium silicate board prepared in accordance with this invention is improved in respect of heat-resistance, fire-resistance, mechanical strength and processability. The conventional asbestos-containing calcium silicate board is thin and has a thickness of 3–15 mm. Accordingly, it has a disadvantage that cracks (if the crack exceeds one tenth of the thickness, it means disqualification for first grade non-combustibility) are formed on its surface when it is heated in the non-combustibility test (JIS A1321 first grade non-combustibility). However, according to the present invention, highly heat-resistant fibrous wollastonite, having a much shorter fiber length compared with asbestos, or a combination of the fibrous wollastonite with highly heat-resistant calcium silicate crystal slurry is used in the mixture of starting materials. Consequently, the heat shrinkage of the board is equalized three dimensionally and therefore the size of the cracks is reduced.

Fibrous wollastonite and pulp intimately adhere to the calcium silicate matrix thereby forming a dense structure due to the reinforcing effect by the fibrous wollastonite and pulp or due to binding action by calcium silicate crystal gel. Thus, the asbestos-free calcium silicate board of this invention is easily prepared without any problem by means of the sheet-forming technique. The board thus prepared is easily handled and has excellent mechanical strength and processibility. That is, the board of this invention is easily processed by means of cutting with a saw, filing or nailing.

Calcium silicate crystal itself is relatively light, and accordingly the bulk density of the product of this invention can be controlled by arranging the amount of the calcium silicate added. Thus, sufficiently light heat insulation material can be obtained. In addition to the above advantages, the calcium silicate crystal undergoes a catalytic action at steaming treatment i.e. a hydrothermal reaction, and therefore the saturated water vapor pressure can be reduced or the steaming time can be reduced. These changes in the hydrothermal reaction conditions lead to reduction of the production cost, and also prevent organic fibers or glassy fiber from being deteriorated by heat or alkali since since the steaming temperature is lowered due to the reduction of the saturated water vapor pressure.

Thus, according to the sheet-forming process of this invention, an asbestos-free calcium silicate raw board having a good texture condition can be produced with high efficiency and high yield using a usual paper-making machine, and the asbestos-free calcium silicate board thus produced is light, highly heat-resistant and fire-resistant, having excellent mechanical strength and processability comparable to the conventional asbestos-containing calcium silicate board.

The raw board formed in accordance with this invention by means of the sheet-forming technique is subjected to a steaming treatment in order to complete crystallization in the reaction of the silicic acid material and lime material.

The steaming treatment is conducted under the following conditions:

(a) In the case of the board prepared in the presence of calcium silicate crystal slurry:

| Saturate Water Vapor | |
|---|---|
| Pressure: | 5 - 18 kg/cm$^2$ |
| Temperature: | 151 - 206° C |
| Time: | 6 - 20 hrs. |

(b) In the case of the board prepared in the absence of calcium silicate crystal slurry:

| Saturated Water Vapor | |
|---|---|
| Pressure: | 7 - 26 kg/cm$^2$ |
| Temperature | 164 - 225° C |
| Time: | 7 - 25 hrs. |

The present invention is further illustrated by the following Example.

EXAMPLE

Fibrous wollastonite having a medium value of 22 $\mu$ for 50% of the fiber distribution (manufactured by Interpace Corporation and sold by the trade name of "Wollastonite F-1"), pulp, siliceous sand and slaked lime were mixed together with or without the presence of calcium silicate crystal slurry obtained by hydrothermal reaction in the weight ratio (on the basis of solid content) shown in Table 2. Water was then added to the above starting materials in 10 times amount of the total weight of the starting materials and the resultant mixture was fully stirred. At the time of sheet-forming, water was additionally added to the slurry of the mixture in such an amount as to provide a slurry having a solid concentration of about 3% by weight. The resultant slurry was formed into a raw board by means of the sheet-forming technique. The raw board was then placed in an autoclave and subjected to a steaming treatment at 183° C. and at a saturated water vapor pressure of 10 kg/cm$^2$ for 10 hours. The treatment board was then dried.

An asbestos-containing board comprising the ingredients disclosed in Table 2 was prepared as a comparative example in the same manner as above. The calcium silicate crystal slurry used in this Example was prepared by mixing quick lime and siliceous sand in a $CaO/SiO_2$ mole ratio of 0.95, adding water to the mixture in 15 times the amount of the total weight of the mixture to form a slurry and subjecting the slurry to a hydrothermal reaction at 200° C. and at a saturated water vapor pressure of 15 kg/cm$^2$ with stirring for 5 hours.

Various properties of the boards thus produced are shown in Table 2.

Table 2

| Ingredients (% by weight) | | Comparative Example | Ex.1 | Ex.2 | Ex.3 | Ex.4 | Ex.5 | Ex.6 | Ex.7 |
|---|---|---|---|---|---|---|---|---|---|
| asbestos | | 22 | 0 | 0 | 0 | 0 | 0 | 0 | 0 |
| fibrous wollastonite | | 0 | 25 | 25 | 40 | 10 | 20 | 20 | 30 |
| pulp | | 0 | 6 | 7 | 2 | 6 | 5 | 5 | 2 |
| silicious sand | | 13 | 37 | 34 | 29 | 30 | 30 | 33 | 29 |
| diatomaceous earth | | 26 | 0 | 0 | 0 | 0 | 0 | 0 | 0 |
| slaked lime | | 39 | 37 | 34 | 29 | 29 | 30 | 32 | 29 |
| calcium silicate crystal slurry (solid content) | | 0 | 5 | 0 | 0 | 25 | 15 | 10 | 10 |
| Properties | | | | | | | | | |
| suitability for sheet-forming (yield, freeness and texture condition) | | good | good | good | good | good | good | good | good |
| bulk density (g/cm$^3$) | | 0.73 | 0.96 | 1.12 | 1.32 | 0.72 | 0.80 | 0.87 | 0.95 |
| bending strength (normal state kg/cm$^2$) | machine direction | 166 | 230 | 235 | 250 | 145 | 170 | 195 | 220 |
| | cross direction | 104 | 150 | 155 | 185 | 95 | 110 | 130 | 145 |
| residual shrinkage (%) after heating the product at 850° C for 3 hours | machine direction | 1.15 | 1.23 | 1.31 | 1.10 | 1.22 | 1.05 | 1.09 | 1.01 |
| | cross direction | 3.04 | 2.54 | 2.72 | 2.32 | 2.35 | 2.31 | 2.42 | 2.02 |
| | thickness direction | 24.30 | 5.37 | 6.43 | 5.74 | 3.31 | 4.46 | 4.57 | 4.30 |
| processibility (cutting, filing and nailing) | | good | good | average | average | good | good | good | good |

What we claim is:

1. A method for making an asbestos-free calcium silicate board, which comprises (a) preparing a slurry of a mixture of 20–50% of silicic acid material, 20–50% of lime material, 10–40% of fibrous wollastonite, 2–10% of pulp selected from the group consisting of N-BKP, N-UKP, flax pulp and waste paper and 1-30% of calcium silicate crystals prepared by hydrothermal synthesis, with water; (b) forming the slurry into a raw board; (c) steaming the raw board; and then (d) drying, all of the said percentages being based on the weight of the total solids content.

2. The method of claim 1 wherein the water is employed in an amount of about 10 times the total solids content.

3. An asbestos-free calcium silicate board prepared in accordance with the method as claimed in claim 1.

* * * * *